US008662202B2

(12) United States Patent
Lee

(10) Patent No.: US 8,662,202 B2
(45) Date of Patent: Mar. 4, 2014

(54) ELECTRO-MECHANICAL THRUSTER

(75) Inventor: Arley G. Lee, Katy, TX (US)

(73) Assignee: Smith International, Inc., Houston, TX (US)

( * ) Notice: Subject to any disclaimer, the term of this patent is extended or adjusted under 35 U.S.C. 154(b) by 1364 days.

(21) Appl. No.: 12/117,583

(22) Filed: May 8, 2008

(65) Prior Publication Data

US 2009/0277687 A1 Nov. 12, 2009

(51) Int. Cl.
*E21B 4/14* (2006.01)

(52) U.S. Cl.
USPC ..... 175/57; 175/296

(58) Field of Classification Search
USPC ..... 175/27, 26, 38, 51, 321, 322
See application file for complete search history.

(56) References Cited

U.S. PATENT DOCUMENTS

| | | | | |
|---|---|---|---|---|
| 4,040,494 | A | 8/1977 | Kellner | |
| 4,615,401 | A * | 10/1986 | Garrett | 175/230 |
| 5,205,364 | A | 4/1993 | Juergens et al. | |
| 5,316,094 | A | 5/1994 | Pringle | |
| 5,476,148 | A * | 12/1995 | LaBonte | 175/27 |
| 5,806,611 | A | 9/1998 | Van Den Steen et al. | |
| 5,884,716 | A | 3/1999 | Beasley | |
| 6,003,606 | A | 12/1999 | Moore et al. | |
| 6,102,138 | A | 8/2000 | Fincher | |
| 6,230,813 | B1 | 5/2001 | Moore et al. | |
| 6,286,592 | B1 | 9/2001 | Moore et al. | |
| 6,601,652 | B1 | 8/2003 | Moore et al. | |
| 6,672,409 | B1 * | 1/2004 | Dock et al. | 175/107 |
| 6,962,213 | B2 * | 11/2005 | Hartwick | 175/57 |
| 7,156,181 | B2 | 1/2007 | Moore et al. | |
| 2001/0045300 | A1 * | 11/2001 | Fincher et al. | 175/26 |
| 2004/0108108 | A1 | 6/2004 | Bailey et al. | |

OTHER PUBLICATIONS

UK Combined Search and Examination Report in GB0808011.1 dated Jul. 1, 2008, 6 pages.

* cited by examiner

*Primary Examiner* — David J Bagnell
*Assistant Examiner* — James G Sayre
(74) *Attorney, Agent, or Firm* — Osha • Liang LLP

(57) ABSTRACT

A drilling system, including: a drill bit; and a thruster to apply a force to the drill bit. The thruster may include: an inner tubular member disposed within and configured to axially move within an outer tubular member; a thrust piston to transmit a hydraulic force to the inner tubular member, the thrust piston separating an upstream fluid chamber and a downstream fluid chamber between the inner and outer tubular members; at least one pressure switch fluidly connected to the downstream fluid chamber to control flow of a fluid to and from the downstream fluid chamber via at least one fluid inlet and at least one fluid outlet.

24 Claims, 4 Drawing Sheets

ELECTRO-MECHANICAL THRUSTER

BACKGROUND OF DISCLOSURE

1. Field of the Disclosure

Embodiments disclosed herein relate generally to thrusters that apply a force to a drill bit during the drilling of an underground formation. In another aspect, embodiments disclosed herein relate to control of a thrust force applied to a drill bit by a thruster. More specifically, embodiments disclosed herein relate to controlling a pressure or differential pressure across a thrust piston, thereby limiting the maximum applied thrust force.

2. Background

Hydraulic thrusters are used for applying a force to an earth boring drill bit, independent of the drill string weight. Although thrusters may be used during vertical or inclined drilling, hydraulic thrusters are generally advantageous in horizontal or near-horizontal drilling. During horizontal drilling, especially in long horizontal sections, a significant portion of the weight of the drill stem is directed toward the low side of the hole, detracting from the weight available for bit thrust. Hydraulic thrusters allow for extended reach drilling, the drilling of multiple horizontal wells from a single platform, decreasing the drilling costs associated with producing reservoirs that are offshore, in arctic regions, mountains, or near large cities.

The thruster is a telescoping tube arrangement that allows the drill bit to advance while the tubing string is supported in a rather stationary position at the surface. When the thruster has advanced its full stroke, or a notable portion thereof, the drill string is lowered from the surface, causing the upper end of the thruster to slide down and reset the thruster for the next stroke. When the drilling kelly or the stand being drilled down by the top drive reaches the drill rig floor, circulation is interrupted and another piece of tubing is added to the string at the surface or the coiled tubing is further unspooled into the wellbore. This drilling procedure also causes the thruster to reset.

Hydraulic thrusters are described in, for example, U.S. Pat. No. 4,615,401 and patents referenced therein (U.S. Pat. Nos. 3,298,449, 3,399,738, 3,797,589, 3,799,277, 4,040,494, and 4,040,495), each of which is assigned to the assignee of the present invention, and each of which is incorporated herein by reference. In the '401 patent, the hydraulic thruster includes a mandrel and sleeve forming two expandable chambers with wall anchors annularly disposed about the sleeve responsive to a pressure differential between a chamber and the bore hole pressure. Valves and actuators are provided to extend and retract a piston between two extremes of relative axial motion between the mandrel and sleeve.

Hydraulic thrusters are also described in U.S. Pat. No. 5,205,364. In the '364 patent, the hydraulic thruster includes a telescoping assembly for transmitting hydraulic force to the drill bit at the bottom of the tool. The internal hydraulic characteristics of the tool may be varied to vary the force exerted during extension and retraction of the telescoping assembly. The hydraulic characteristics are varied by varying the surface area within the drill tool on which the flow of drilling mud may act when producing the hydraulic force.

Other patents describing thrusters or equipment for controlling force or weight on the bit, for example, may include U.S. Pat. Nos. 5,316,094, 6,601,652, 7,156,181, 5,476,148, 5,884,716, 5,806,611, 6003,606, 6,230,813, and 6,286,592, and U.S. Patent Application Publication No. 20010045300.

Referring now to FIG. 1, a simplified cross-sectional view of a prior art thruster 1 is illustrated. Thruster 1, shown in the retracted position, may include an inner mandrel assembly 2, which may include one or more tubular components. Threads 3 may connect inner mandrel assembly 2 to the lower drill stem (not shown) toward the bit (not shown). Threads 4 may connect inner mandrel assembly 2 to the upper drill stem (not shown). Inner mandrel assembly 2 is disposed in and is axially movable with respect to outer tubular assembly 5. One or more anchor pistons 6 may be provided to anchor thruster 1 with respect to the hole wall (not shown). Drilling fluid supplied to the bore 2A of inner mandrel 2 and to the drill bit (not shown) defines a high pressure area, and drilling fluid returning from the bit in the annulus 7 formed between the outer tubular assembly 6 and the hole wall defines a low pressure area. During thrusting, thrust mechanism 8 may be used to allow the high pressure drilling fluid into chamber A, allowing fluid in chamber B to escape to annulus 7, thus creating a pressure differential across thrust mechanism 8, causing the inner mandrel 2 to advance in direction 9, and putting weight on the bit corresponding to the thrust force generated by the pressure differential.

A cross-sectional view of a simplified thrust mechanism 8, which may be used in the thruster of FIG. 1, is illustrated in FIG. 2. Thrust mechanism 8 may include an inner tubular member 12 and an outer tubular member 14. Drilling mud flowing through the bore 16 of inner tubular member 12 flows to the drill bit (not shown), and returns to the surface via annulus 18, such as between outer tubular member 14 and a drill casing (not shown). When mud is flowing through thruster 1 (FIG. 1), bore 16 is at a higher pressure than fluid returning through annulus 18. A piston 20, separating a first fluid chamber 22 and a second fluid chamber 24, may transmit an axial force 26 to inner tubular member 12. During thrusting, high pressure drilling mud flows from the bore 16 of the thruster 1 through inlet 28 into first fluid chamber 22, displacing fluid in second fluid chamber 24 through outlet 30 and causing the inner tubular member 12 to advance in the direction of axial force 26. The axial force 26 that is generated, for example, may be a function of the differential pressure between the fluid in bore 16 and annulus 18.

Many of the patents cited above use such a differential pressure to control the force applied to the drill bit. Although not shown in FIG. 2, thrust mechanism 8 may typically include ball valves, springs, and other mechanisms to control the flow of fluid into and from the high and low pressure chambers, respectively, during thrusting and retraction. One problem associated with this type of thruster technology includes the need to estimate the pressure and required thrust force prior to drilling. The thruster and the associated internal parts are generally selected and fabricated at the surface prior to installation on a drill string, and many of the parts used to control fluid flow, such as springs, check valves, flow orifices, and others, are sized and selected based on an expected downhole pressure.

Often, an actual downhole pressure differs from the expected downhole pressure. The difference between actual and expected downhole pressure, even by as little as 25 or 50 psi, may result in ineffective control of the force applied to the drill bit by the thruster, often as a result of the thrust mechanism fully opening or fully closing. Additionally, fluctuations in pressure drop across the bit and changes in the weight of the drilling fluid used (and hence bore pressure) may also result in ineffective control of the force applied to the drill bit by the thruster. Ineffective thruster control may lead to stalls, motor wear, stuck bits, and inefficient rate of penetration, among other problems known to those skilled in the art.

Various methods and apparatus have been proposed to compensate for a change in downhole conditions and to minimize the effect such changes have on the operation of the thruster and the force applied to the drill bit. For example, a pressure-modulation valve assembly is disclosed in U.S. Pat. No. 6,102,138. Such methods and apparatus unnecessarily increase the total number of drilling components of a drill string, where the additional apparatus may be prone to failure or malfunction due to various conditions encountered during drilling.

Accordingly, there exists a need for a thruster that may control the force applied to a drill bit independent of the downhole pressure or the pressure drop across the motor and bit. Additionally, there exists a need for a thruster that may control the force applied to the bit independent of the pressure of the supplied drilling fluid.

SUMMARY OF THE DISCLOSURE

In one aspect, embodiments disclosed herein relate to a drilling system, including: a drill bit; and a thruster to apply a force to the drill bit. The thruster may include: an inner tubular member disposed within and configured to axially move within an outer tubular member; a thrust piston to transmit a hydraulic force to the inner tubular member, the thrust piston separating an upstream fluid chamber and a downstream fluid chamber between the inner and outer tubular members; at least one pressure switch fluidly connected to the downstream fluid chamber to control flow of a fluid to and from the downstream fluid chamber via at least one fluid inlet and at least one fluid outlet.

In another aspect, embodiments disclosed herein relate to a thruster, including: an inner tubular member disposed within and configured to axially move within an outer tubular member; a thrust piston to transmit a hydraulic force to the inner tubular member, the thrust piston separating an upstream fluid chamber and a downstream fluid chamber between the inner and outer tubular members; a downstream valve member mechanically coupled to a downstream magneto-actuator and disposed in the downstream fluid chamber; and at least one pressure switch fluidly coupled to the downstream fluid chamber to control a position of the downstream valve member via the magneto-actuator; wherein the position of the downstream valve member affects a flow of a fluid to and from the downstream fluid chamber via at least one fluid inlet and at least one fluid outlet.

In another aspect, embodiments disclosed herein relate to a process to drill an underground formation. The process may include: supplying a fluid to a thruster, wherein the thruster includes: an inner tubular member disposed within and configured to axially move within an outer tubular member; a thrust piston to transmit a hydraulic force to the inner tubular member, the piston separating an upstream fluid chamber and a downstream fluid chamber between the inner tubular member and the outer tubular member; at least one pressure switch fluidly connected to the downstream fluid chamber; and regulating a flow of the fluid to and from the downstream fluid chamber in response to a signal from the at least one downstream pressure switch to maintain the hydraulic force applied to the inner tubular member proximate a hydraulic force set point.

Other aspects and advantages will be apparent from the following description and the appended claims.

DETAILED DESCRIPTION

In one aspect, embodiments disclosed herein relate to control of a thrust force applied to a drill bit by a thruster. More specifically, embodiments disclosed herein relate to controlling a pressure or differential pressure across a thrust piston, thereby limiting the maximum applied thrust force. Other embodiments disclosed herein relate to a method of drilling a formation using a thruster that may limit the thrust force applied to the bit independent of bore and annulus fluid pressures.

As described above, prior art thrusters generate an axial force based upon a difference in bore and annulus pressures. In contrast, thrusters disclosed herein include mechanisms to regulate the pressure in one or both of the upstream and downstream fluid chambers. The axial force generated according to embodiments disclosed herein, for example, may be a function of the differential pressure between the fluid in the upstream and downstream fluid chambers.

Figure 1:
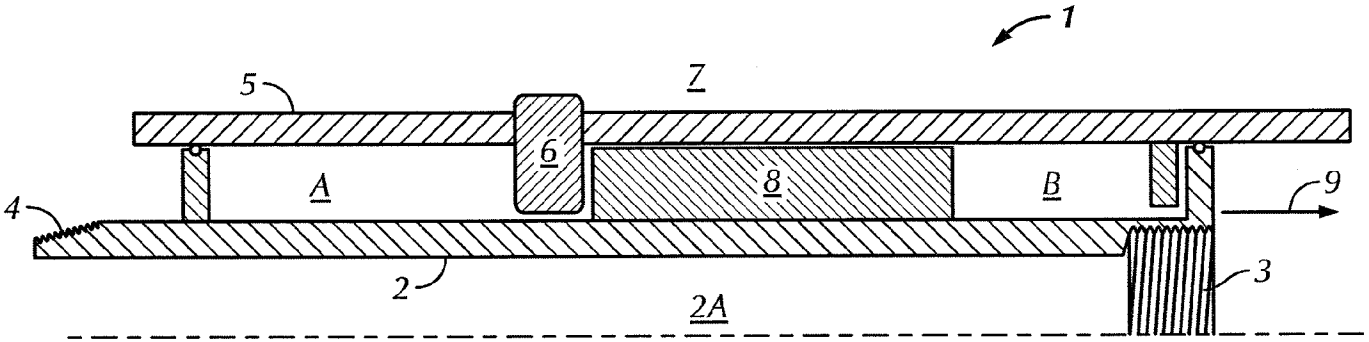
FIG. 1 (Prior Art)
FIG. 1 is a simplified schematic drawing of a prior art thruster.
Figure 2:
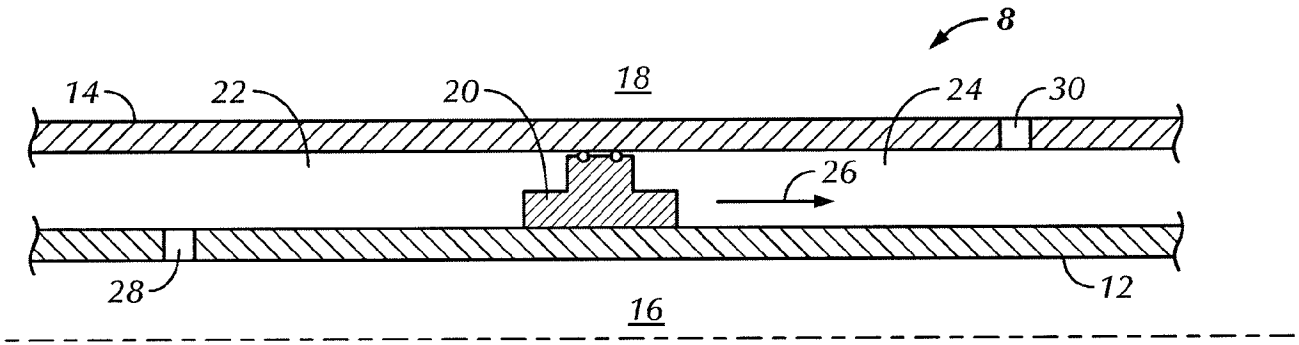
FIG. 2 (Prior Art)
FIG. 2 is a schematic drawing of a simplified thrust mechanism that may be used in the prior art thruster of FIG. 1.
Figure 3:
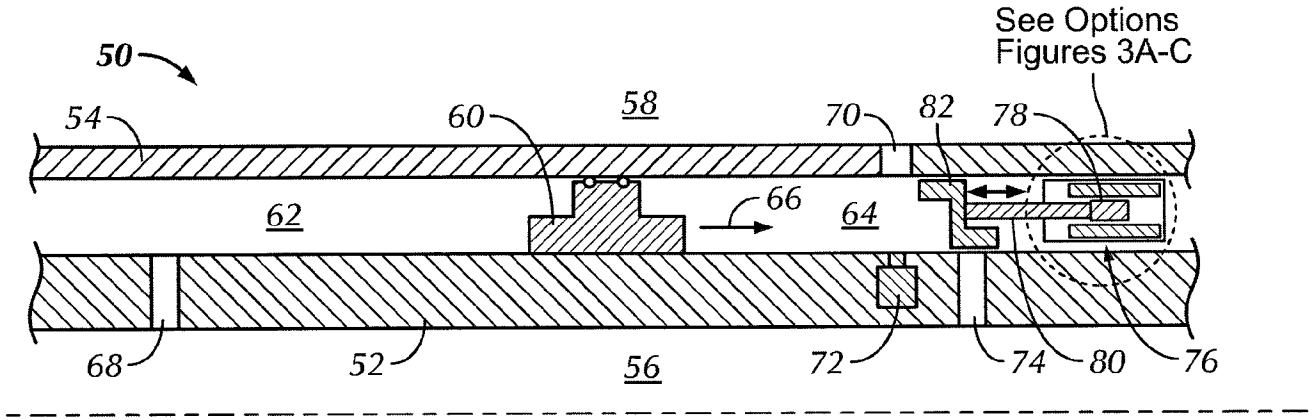
FIG. 3 is a simplified schematic drawing of a thruster according to embodiments disclosed herein.

Referring now to FIG. 3, a simplified schematic drawing of a thruster 50 according to embodiments disclosed herein is illustrated. Thruster 50 may include an inner tubular member 52 and an outer tubular member 54. Drilling mud flowing through the bore 56 of inner tubular member 52 flows to the drill bit (not shown), and returns to the surface via annulus 58, such as between outer tubular member 54 and a drill casing (not shown). When mud is flowing through thruster 50, bore 56 is at a higher pressure than fluid returning through annulus 58. A thrust piston 60, separating an upstream fluid chamber 62 and a downstream fluid chamber 64, may transmit an axial force 66 to inner tubular member 52. During thrusting, high pressure drilling mud flows from the bore 56 of the thruster 50 through inlet 68 into upstream fluid chamber 62, displacing low pressure fluid in downstream fluid chamber 64 through outlet 70 and causing the inner tubular member 52 to advance in the direction of axial force 66.

To regulate thrust force, or differential pressure between the upstream chamber 62 and the downstream chamber 64, for example, thruster 50 may include a pressure switch 72, which may be in fluid communication with the downstream fluid chamber 64. Pressure switch 72, in some embodiments, may be a pressure limit switch, activating at a pressure set point. When the fluid in chamber 64 reaches a predetermined set point pressure, the pressure switch 72 may actuate. Upon actuation, pressure switch 72 may send an electronic signal to a control mechanism (not shown) for regulating the flow of fluid into or out of downstream fluid chamber 64 through downstream inlet 74 and outlet 70.

By sending a signal to regulate the flow of fluid into and out of downstream fluid chamber 64, pressure switch 72 may limit the thrust force applied to the drill bit, thus avoiding the full on or full off scenarios often encountered with prior art thrusters. For example, by limiting the flow of fluid through outlet 70, pressure will build in downstream fluid chamber 64, limiting the applied thrust force. As another example, by allowing fluid to flow in through inlet 74, pressure will also increase in downstream fluid chamber 64, due to high pressure fluid in bore 56, limiting the applied thrust force.

The control mechanism may in turn send a signal or a current to a valve member 76 to regulate the flow of fluid into and out of downstream fluid chamber 64. Valve member 76 may include, for example, an actuator 78, a drive rod 80, and a gate member 82. The signal or current transmitted to valve member 76 may cause actuator 78 to extend or contract, as illustrated by the arrows, causing a similar displacement in drive rod 80, causing gate 82 to open and/or close fluid inlet 74 and/or fluid outlet 70. Other means of regulating fluid flow using a signal from a pressure switch are also contemplated herein.

Actuator 78 may include any one of several types of actuators responsive to electronic signals or currents. For example, actuator 78 may include magnetostrictive actuators, shape memory alloy actuators, and linear motor actuators. Examples of each of these are illustrated in FIGS. 3A-3C.

Figure 3C:
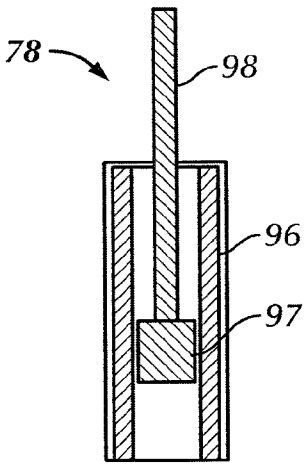
FIG. 3C is a simplified schematic drawing of an actuator useful in embodiments of the thrusters described herein.
Figure 3B:
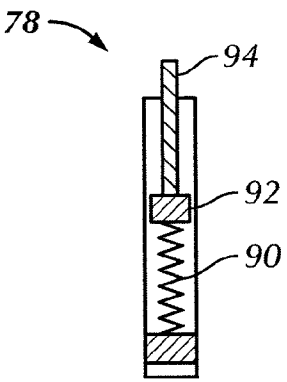
FIG. 3B is a simplified schematic drawing of an actuator useful in embodiments of the thrusters described herein.
Figure 3A:
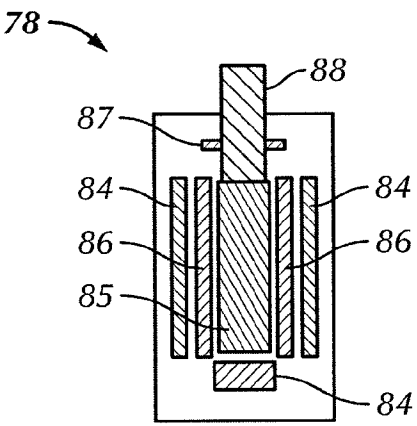
FIG. 3A is a simplified schematic drawing of an actuator useful in embodiments of the thrusters described herein.

As illustrated in FIG. 3A, actuator 78 may include a magnetostrictive actuator, including permanent magnets 84, drive rod 85, coil 86, preload springs 87, and output rod 88. Upon application of a current through coil 86, drive rod 85 may expand or contract in response to the magnetic field generated, thereby displacing output rod 88 to control the position of the gate member 82 and thus control the flow of fluid to and from the downstream cavity 64.

As illustrated in FIG. 3B, actuator 78 may include a shape memory alloy actuator, including shape memory alloy spring 90, piston 92, and drive rod 94. Upon application of an electrical current, shape memory alloy spring may expand or contract, thereby displacing piston 92 and drive rod 94 to control the position of the gate member 82, and thus control the flow of fluid to and from the downstream cavity 64.

As illustrated in FIG. 3C, actuator 78 may include a linear motor actuator, including a stationary member 96, a motive member 97, and a drive rod 98. Linear motor actuators may include flat linear motor actuators and, as illustrated, tubular linear motor actuators. In some embodiments, a signal sent from the control mechanism to the linear motor actuator may control the position of the motive member 97, and thus drive rod 98, with respect to stationary member 96. In other embodiments, a signal sent from the control mechanism to the linear motor actuator may control an output force exerted on drive rod 98. In this manner, the linear motor actuator may control the position of gate member 82, and thus control the flow of fluid to and from the downstream cavity 64.

Figure 4:
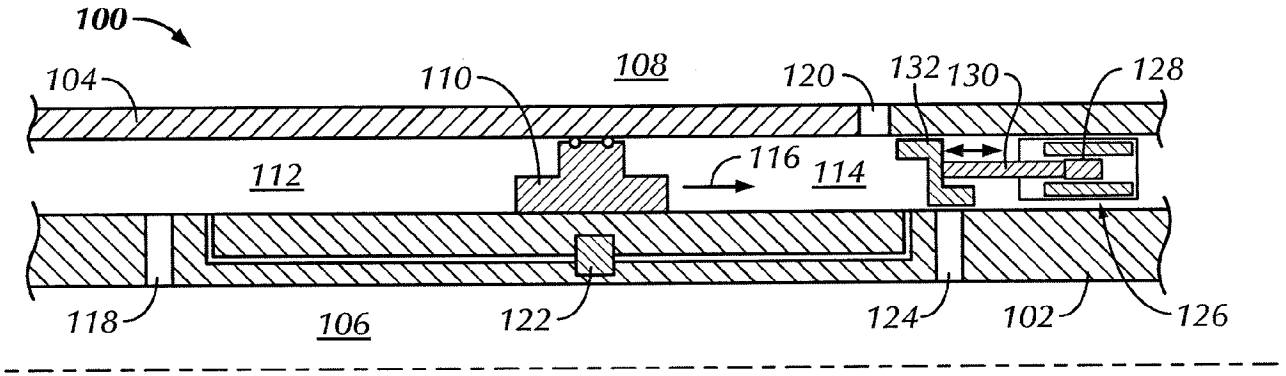
FIG. 4 is a simplified schematic drawing of a thruster according to embodiments disclosed herein.

Referring now to FIG. 4, a simplified schematic drawing of a thruster 100 according to embodiments disclosed herein is illustrated. Thruster 100 may include an inner tubular member 102 and an outer tubular member 104. Drilling mud flowing through the bore 106 of inner tubular member 102 flows to the drill bit (not shown), and returns to the surface via annulus 108, such as between outer tubular member 104 and a drill casing (not shown). When mud is flowing through thruster 100, bore 106 is at a higher pressure than fluid returning through annulus 108. A thrust piston 110, separating an upstream fluid chamber 112 and a downstream fluid chamber 114, may transmit an axial force 116 to inner tubular member 102. During thrusting, high pressure drilling mud flows from the bore 106 of the thruster 100 through inlet 118 into upstream fluid chamber 112, displacing low pressure fluid in downstream fluid chamber 114 through outlet 120 and causing the inner tubular member 102 to advance in the direction of axial force 116.

To regulate thrust force, or differential pressure between the upstream chamber 112 and the downstream chamber 114, for example, thruster 100 may include a pressure switch 122, which may be in fluid communication with each of the upstream fluid chamber 112 and the downstream fluid chamber 114. Pressure switch 122, in some embodiments, may be a differential pressure limit switch, activating at a differential pressure set point. When the differential pressure of the fluid in upstream and downstream chambers 112, 114 reaches a pre-determined differential pressure set point, the pressure switch 122 may actuate. Upon actuation, pressure switch 122 may send an electronic signal to a control mechanism (not shown) for regulating the flow of fluid into or out of downstream fluid chamber 114 through downstream inlet 124 and outlet 120. By sending a signal to regulate the flow of fluid into and out of downstream fluid chamber 114, pressure switch 122 may regulate the thrust force applied to the drill bit, as described above.

The control mechanism may in turn send a signal or a current to a valve member 126 to regulate the flow of fluid into and out of downstream fluid chamber 114. Valve member 126 may include, for example, an actuator 128, a drive rod 130, and a gate member 132. The signal or current transmitted to valve member 126 may cause actuator 128 to extend or contract, as illustrated by the arrows, causing a similar displacement in drive rod 130, causing gate 132 to open and/or close fluid inlet 124 and/or fluid outlet 120.

Figure 5:
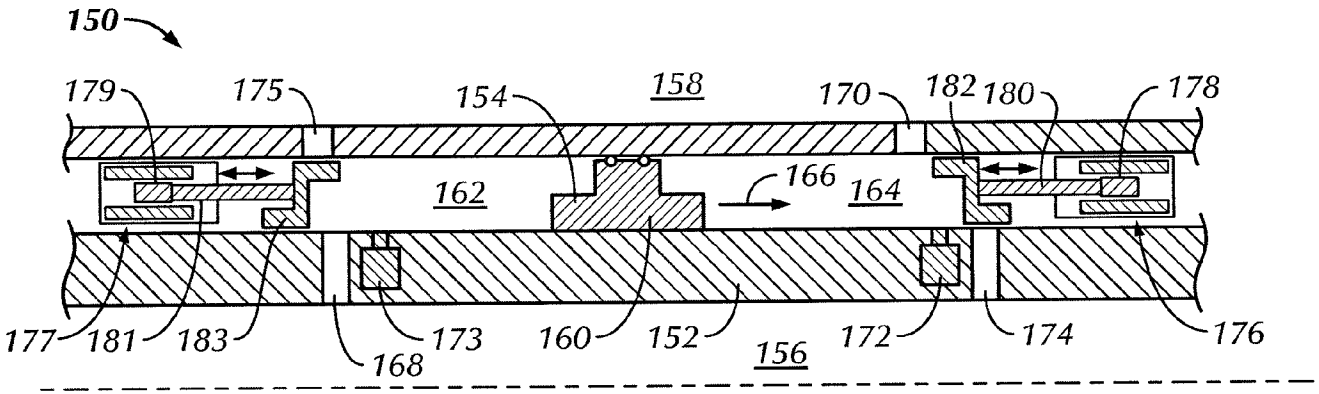
FIG. 5 is a simplified schematic drawing of a thruster according to embodiments disclosed herein.

Referring now to FIG. 5, a simplified schematic drawing of a thruster 150 according to embodiments disclosed herein is illustrated. Thruster 150 may include an inner tubular member 152 and an outer tubular member 154. Drilling mud flowing through the bore 156 of inner tubular member 152 flows to the drill bit (not shown), and returns to the surface via annulus 158, such as between outer tubular member 154 and a drill casing (not shown). When mud is flowing through thruster 150, bore 156 is at a higher pressure than fluid returning through annulus 158. A thrust piston 160, separating an upstream fluid chamber 162 and a downstream fluid chamber 164, may transmit an axial force 166 to inner tubular member 152. During thrusting, high pressure drilling mud flows from the bore 156 of the thruster 150 through inlet 168 into upstream fluid chamber 162, displacing low pressure fluid in downstream fluid chamber 164 through outlet 170 and causing the inner tubular member 152 to advance in the direction of axial force 166.

To regulate thrust force, or differential pressure between the upstream chamber 162 and the downstream chamber 164, for example, thruster 150 may include a pressure switch 172, which may be in fluid communication with the downstream fluid chamber 164. Pressure switch 172, in some embodiments, may be a pressure limit switch, activating at a pressure set point. When the fluid in chamber 164 reaches a pre-determined set point pressure, the pressure switch 172 may actuate. Upon actuation, pressure switch 172 may send an electronic signal to a control mechanism (not shown) for regulating the flow of fluid into or out of downstream fluid chamber 164 through downstream inlet 174 and outlet 170. Thruster 150 may also include a pressure switch 173, which may be in fluid communication with the upstream fluid chamber 162. When the fluid in chamber 162 reaches a pre-determined set point pressure, the pressure switch 173 may actuate, sending an electronic signal to a control mechanism (not shown) for regulating the flow of fluid into or out of upstream fluid chamber 162 through upstream inlet 168 and upstream outlet 175. By sending a signal to regulate the flow of fluid into and out of upstream fluid chamber 162 and downstream fluid chamber 164, pressure switches 173, 172 may each, separately or collectively, limit the thrust force applied to the drill bit.

The control mechanism may in turn send a signal(s) or a current(s) to valve members 176, 177 to regulate the flow of fluid into and out of one or both of upstream and downstream fluid chambers 162, 164. Valve members 176, 177 may include, respectively, for example, actuators 178, 179, drive rods 180, 181, and gate members 182, 183. The signal(s) or current(s) transmitted to valve members 176, 177 may cause actuators 178, 179 to extend or contract, as illustrated by the arrows, causing a similar displacement in drive rods 180, 181, causing gates 182, 183 to open and/or close fluid inlets 174, 175 and/or fluid outlets 170, 171. In some embodiments, valve action on both sides of the thrust piston 160 is required in order to have hydraulic volume flow in the upstream and downstream chambers 162, 164.

Figure 6:
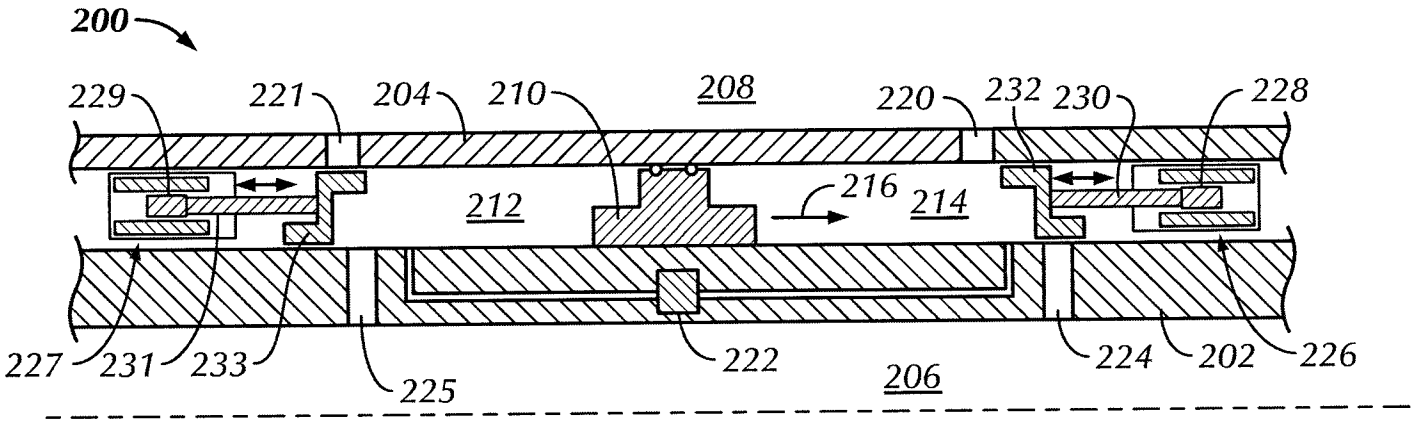
FIG. 6 is a simplified schematic drawing of a thruster according to embodiments disclosed herein.

Referring now to FIG. 6, a simplified schematic drawing of a thruster 200 according to embodiments disclosed herein is illustrated. Thruster 200 may include an inner tubular member 202 and an outer tubular member 204. Drilling mud flowing through the bore 206 of inner tubular member 202 flows to the drill bit (not shown), and returns to the surface via annulus 208, such as between outer tubular member 204 and a drill casing (not shown). When mud is flowing through thruster 200, bore 206 is at a higher pressure than fluid returning through annulus 208. A thrust piston 210, separating an upstream fluid chamber 212 and a downstream fluid chamber 214, may transmit an axial force 216 to inner tubular member 202. During thrusting, high pressure drilling mud flows from the bore 206 of the thruster 200 through inlet 218 into upstream fluid chamber 212, displacing low pressure fluid in downstream fluid chamber 214 through outlet 220 and causing the inner tubular member 202 to advance in the direction of axial force 216.

To regulate thrust force, or differential pressure between the upstream chamber 212 and the downstream chamber 214, for example, thruster 200 may include a differential pressure switch 222, which may be in fluid communication with each of the upstream fluid chamber 212 and the downstream fluid chamber 214. When the differential pressure of the fluid in upstream and downstream chambers 212, 214 reaches a predetermined differential pressure set point, the pressure switch 222 may actuate, sending an electronic signal to a control mechanism (not shown) for regulating the flow of fluid into or out of one or both of upstream and downstream fluid chambers 212, 214, thereby limiting the thrust force applied to the drill bit.

The control mechanism may in turn send a signal(s) or a current(s) to valve members 226, 227 to regulate the flow of fluid into and out of one or both of upstream and downstream fluid chambers 212, 214. Valve members 226, 227 may include, respectively, for example, actuators 228, 229, drive rods 230, 231, and gate members 232, 233. The signal(s) or current(s) transmitted to valve members 226, 227 may cause actuators 228, 229 to extend or contract, as illustrated by the arrows, causing a similar displacement in drive rods 230, 231, causing gates 232, 233 to open and/or close fluid inlets 224, 225 and/or fluid outlets 220, 221. In some embodiments, valve action on both sides of the thrust piston 210 is required in order to have hydraulic volume flow in the upstream and downstream chambers 212, 214.

As described above, operation and control of the thrusters described herein may be affected by remote signals, such as by actuating valves and other thruster components. In some embodiments, the control settings for the valves, actuators, and pressure switches may be adjusted using remote signals.

In other embodiments, the operation and control of the thrusters described herein may be affected by down-linking a signal from the surface. For example, a signal from the surface may be used to communicate with the thruster control mechanism, such as to influence the forward movement of the thruster to initiate a change in drilling rate, a change in drilling direction, or other drilling parameters, for example. Down-linking signals, in some embodiments, may include a change in pump pressure at the surface held for a given period of time. In other embodiments, down-linking signals may include a positive and/or negative pressure pulses, such as may be actuated by a change in standpipe pressure, for example. In this manner, down-linking may be used to accurately position a well and improve drilling performance.

Embodiments disclosed herein may include one or more pressure switches and/or differential pressure switches to result in the desired thrust control. In some embodiments, the pressure switches may actuate upon increasing pressure or pressure differential. In other embodiments, the pressure switches may actuate upon decreasing pressure or pressure differential. In yet other embodiments, combinations of pressure switches actuating upon increasing and decreasing pressure differential may be used, such as where a valve member opens upon increasing pressure differential in response to a signal from a first pressure switch, and the valve member closes upon decreasing pressure differential in response to a signal from a second pressure switch. Additionally, embodiments may include pressure switches and differential pressure switches in fluid communication with one or more of the upstream chamber, the downstream chamber, the inner tubular member bore, and the annulus between the outer tubular member and the hole wall, with the pressure switch actuating upon a give pressure or pressure differential so as to regulate thrust force.

As described above, use of pressure switches and actuators may provide for passive thrust force control. For example, a pressure switch may actuate at a minimum or maximum desired thrust force, sensing a fully opened or fully closed condition, and thereafter adjusting the pressures in the upstream and downstream chambers.

Embodiments disclosed herein may include one or more actuators to result in active thrust force control. In some embodiments, two or more actuators, of the same or different type, may be used in parallel, such as operating two or more gate members, or in series, such as to achieve a longer stroke length. Additionally, intermediate components may be used intermediate drive rod and gate member, such as lever arms and bell cranks, among others, so as to result in the desired valve action or stroke length.

Embodiments disclosed herein may include two or more actuators and pressure switches in parallel to control fluid flow into and from a fluid chamber. In some embodiments, the two or more pressure switches may include different pressure set points, such that a valve member may reset prior to a subsequent cycle, for example. Pressure set points may be varied minimally so as to maintain a similar maximum thrust force upon actuation of the various switch/actuator/valve combinations.

As described above, use of pressure switches and actuators in parallel or series may provide for active thrust force control. For example, when approaching a fully opened or fully closed condition, the pressure switches may actuate, adjusting the pressures in the upstream and downstream chambers and thereby operating the thruster within a desired range of thrust force.

In other embodiments, two or more actuators and pressure switches may be used in series to control fluid flow into and from a fluid chamber. For example, two or more pressure switches may include different set points, such that actuators extend or contract at different pressure set points. Upon actuation of a first pressure switch/actuator pair, a minimal flow opening may be provided to limit thrust force. If differential pressure continues to increase following actuation of the first pressure switch/actuator pair, a second and subsequent pressure switch/actuator pairs may provide additional flow area to limit the thrust force applied to the bit. In this manner, thrust force may vary less significantly than an on/off type actuator/valve member.

Although described with reference to the pressure chambers, one skilled in the art will recognize that embodiments of thrusters disclosed herein may include components that may be typically included in thrusters, such as the thrusters described in U.S. Pat. No. 4,615,401 and others mentioned above. For example, thrusters disclosed herein may include anchor assemblies, ball valves, seals, springs and spring assemblies, threaded connections, spacers, snap rings, bearings, pins, valve seats, and rods, among others. Components used to regulate fluid flow during resetting of the thruster may also be included.

In some embodiments, additional measurement and control devices may also be used to limit or control the thrust force. For example, a sensor measuring rate of penetration may be used to actuate the valve members, thereby controlling the flow of fluid into and from the upstream and downstream fluid chambers. In this manner, rate of penetration may be maintained within a desired range, such as within an optimal range for a particular drill bit. Stroke measurement devices or position sensors may also be used to indicate the thruster position, thereby allowing an operator to slow the rate of thrust toward the end of a stroke.

In some embodiments, power and currents supplied to the control mechanisms, pressure switches, and actuators may include electrical currents supplied from batteries. In other embodiments, power and currents may be supplied to the control mechanisms, pressure switches, and actuators may include electrical currents supplied from downhole generators, such as turbine generators and the like.

Advantageously, embodiments disclosed herein may provide for improved thrust force control, or improved control of the weight on bit. Actuators, pressure switches and valve members described herein may advantageously limit the pressure differential between upstream and downstream chambers, thus limiting the thrust force transmitted by the thrust piston to the inner tubular member. Additionally, for embodiments limiting the pressure or pressure differential within each fluid chamber, the maximum thrust force applied may be controlled independent of fluid pressure in the inner bore and the annulus. Embodiments disclosed herein, through limiting applied thrust force, may advantageously maintain weight on bit within a desired range, improving rates of penetration, and decreasing motor wear and the occurrence of stuck bits and stalls, among other common problems known in the art.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A drilling system, comprising:

a drill bit; and a thruster to apply a force to the drill bit, the thruster comprising:

an inner tubular member disposed within and configured to axially move within an outer tubular member;

a thrust piston to transmit a hydraulic force to the inner tubular member, the thrust piston separating an upstream fluid chamber and a downstream fluid chamber between the inner and outer tubular members;

at least one pressure switch fluidly connected to the downstream fluid chamber to control flow of a fluid to and from the downstream fluid chamber via at least one fluid inlet and at least one fluid outlet; and a valve member disposed in at least one of the downstream fluid chamber and an upstream fluid chamber, wherein the valve member comprises a magneto-actuator.

2. The thruster of claim 1, wherein the at least one downstream pressure switch is selected from the group consisting of pressure switches and differential pressure switches.

3. The thruster of claim 1, wherein the at least one pressure switch fluidly connected to the downstream fluid chamber affects a position of the valve member, and wherein the position of the valve member affects the flow of fluid to and from the downstream chamber.

4. The thruster of claim 1, wherein the magneto-actuator comprises at least one selected from the group consisting of, a magnetostrictive actuator, and a linear motor actuator.

5. The thruster of claim 1, further comprising a power source electronically coupled to the magneto-actuator.

6. The thruster of claim 5, wherein the power source comprises at least one of a battery and a turbine generator.

7. The thruster of claim 1, further comprising at least one pressure switch fluidly coupled to the upstream fluid chamber to control flow of a fluid to and from the upstream fluid chamber via at least one fluid inlet and at least one fluid outlet.

8. The thruster of claim 7, wherein the upstream pressure switch is selected from the group consisting of pressure switches and differential pressure switches.

9. The thruster of claim 8, wherein the at least one upstream pressure switch affects a position of the valve member, and wherein the position of the valve member affects the flow of fluid to and from the downstream chamber.

10. The thruster of claim 9, further comprising a power source electronically coupled to the magneto-actuator.

11. The thruster of claim 10, wherein the power source comprises at least one of a battery and a downhole generator.

12. A thruster, comprising:

an inner tubular member disposed within and configured to axially move within an outer tubular member;

a thrust piston to transmit a hydraulic force to the inner tubular member, the thrust piston separating an upstream fluid chamber and a downstream fluid chamber between the inner and outer tubular members;

a downstream valve member mechanically coupled to a downstream magneto-actuator and disposed in the downstream fluid chamber; and at least one pressure switch fluidly coupled to the downstream fluid chamber to control a position of the downstream valve member via the magneto-actuator;

wherein the position of the downstream valve member affects a flow of a fluid to and from the downstream fluid chamber via at least one fluid inlet and at least one fluid outlet.

13. The thruster of claim 12, wherein the at least one pressure switch comprises a differential pressure switch fluidly coupled to the upstream fluid chamber.

14. The thruster of claim 12, further comprising at least one pressure switch fluidly coupled to the upstream fluid chamber.

15. The thruster of claim 12, further comprising an upstream valve member, mechanically coupled to an upstream magneto-actuator, disposed in the upstream fluid chamber.

16. The thruster of claim 15, wherein each of the upstream and downstream magneto-actuators comprises at least one selected from the group consisting of a magnetostrictive actuator, a linear motor actuator.

17. The thruster of claim 12, further comprising a power source electronically coupled to an upstream magnetoactuator and the downstream magneto-actuators.

18. The thruster of claim 17, wherein the power source comprises at least one of a battery and a turbine generator.

19. The thruster of claim 12, further comprising an anchor.

20. A process to drill an underground formation, the process comprising:

supplying a fluid to a thruster, wherein the thruster comprises:

an inner tubular member disposed within and configured to axially move within an outer tubular member;

a thrust piston to transmit a hydraulic force to the inner tubular member, the piston separating an upstream fluid chamber and a downstream fluid chamber between the inner tubular member and the outer tubular member;

at least one pressure switch fluidly connected to the downstream fluid chamber;

regulating a flow of the fluid to and from the downstream fluid chamber in response to a signal from the at least one downstream pressure switch to maintain the hydraulic force applied to the inner tubular member proximate a hydraulic force set point; and supplying power to at least one upstream pressure switch and an upstream magneto-actuator disposed in the upstream chamber.

21. The process of claim 20, further comprising regulating a flow of the fluid to and from the upstream fluid chamber in response to a signal from the at least one upstream pressure switch.

22. The process of claim 20, further comprising supplying power to the at least one downstream pressure switch and a downstream magneto-actuator disposed in the downstream chamber.

23. The process of claim 20, further comprising anchoring the thruster.

24. The process of claim 20, further comprising resetting the thruster.

* * * * *